United States Patent [19]

Ferrigno

[11] 4,450,848

[45] May 29, 1984

[54] ARTIFICIAL FINGERNAIL FORMING METHOD, COMPOSITION AND KIT

[76] Inventor: Elisa L. Ferrigno, 107 Glen Rd. - Apt. 4C, Yonkers, N.Y. 10470

[21] Appl. No.: 427,105

[22] Filed: Sep. 29, 1982

[51] Int. Cl.[3] ..... A45D 29/00

[52] U.S. Cl. ..... 132/73

[58] Field of Search ..... 132/73, 79

[56] References Cited

U.S. PATENT DOCUMENTS

| | | | |
|---|---|---|---|
| 2,746,460 | 5/1956 | Jelliner | 132/73 |
| 3,478,756 | 11/1969 | Sautter et al. | 132/73 |
| 4,007,748 | 2/1977 | Matranga | 132/73 |
| 4,299,243 | 11/1981 | Unstattd | 132/73 |

*Primary Examiner*—Gregory E. McNeill

*Attorney, Agent, or Firm*—Sprung, Horn, Kramer & Woods

[57] ABSTRACT

An artificial fingernail forming method, composition and kit comprises adhering a plastic fingernail tip to the top surface of the free end of a natural fingernail, applying a thin coating of a liquid cyanoacrylate adhesive to the top surface of the natural fingernail rearward of the tip, applying a thin layer of an acrylic ester polymer in powder form on the adhesive coating while still wet, applying a second thin coating of the liquid cyanoacrylate to the surface of the layer after drying and buffing the surface until smooth after the liquid dries.

5 Claims, No Drawings

ARTIFICIAL FINGERNAIL FORMING METHOD, COMPOSITION AND KIT

BACKGROUND OF THE INVENTION

The present invention relates to artificial fingernails and in particular to a method of forming an artificial nail on a natural nail, an artificial nail composition and a kit for forming an artificial nail on a natural nail.

At the present time, artificial fingernails for cosmetic and other purposes are either prefabricated out of plastic material and glued on the natural nail or, in a much more time consuming and expensive process are formed in situ on the natural nail.

Artificial ernails are commonly worn by women in order to impart a well groomed appearance of uniformly long and uniformly shaped fingernails. Alternatively, the artificial fingernails may be used to replace a broken natural nail.

It is now also becoming common for men to use artificial fingernails, especially where the man bites his fingernails and renders them unattractive.

Conventional artificial fingernails, which are formed in situ, tend to remain in place approximately two weeks and thereafter begin to lift off and require replacement. It has been observed that while women do not mind returning every two to three weeks to replace the artificial fingernails, men tend to resist such frequent replacements.

SUMMARY OF THE INVENTION

The main object of the present invention is to provide an artificial nail which will have all of the aesthetic characteristics of the in situ formed artificial fingernails while being able to remain in place longer without the need for repair or replacement. In accordance with this object, the present invention provides a method of forming an artificial fingernail on a natural fingernail, an artificial fingernail composition and a kit for forming an artificial fingernail on a natural fingernail which achieve this object.

These and other objects of the present invention are achieved in accordance with the present invention by a method wherein a conventional plastic fingernail tip is adhered to the surface of the free end of a natural nail, a thin coating of a liquid cyanoacrylate adhesive is applied to the top surface of the natural fingernail rearward of the tip, a thin layer of an acrylic ester polymer in powder form is applied on the adhesive coating while the coating is still wet, applying a second thin coating of the liquid cyanoacrylate adhesive to the surface of the polymer after drying and buffing the polymer surface until smooth after the liquid dries.

The artificial fingernail composition therefore comprises an acrylic ester polymer and a cyanoacrylate adhesive. The acrylic ester polymer may be any commercially supplied polymer powder composition for fingernail preparations, in particular an acrylic ester polymer composition containing polymethylmethacrylate and benzoyl peroxide. The cyanoacrylate adhesive can be any commercially available fast drying one such as Krazy Glue TM or 5 Second Nail Glue TM which comprises ethyl alpha cyanoacrylate.

The kit according to the present invention comprises at least one plastic fingernail tip, preferably an acetate plastic conventionally used for artificial nails, an adhesive for retaining the tip on the natural fingernail, a liquid cyanoacrylate adhesive, an acrylic ester polymer powder, means for applying the thin coating of the liquid cyanoacrylate adhesive, preferably a wooden stick, and means for smoothing the tip surface of the formed artificial ernail, preferably super fine sandpaper.

These and other objects and advantages of the present invention are achieved in accordance with the present as disclosed in more detail hereinafter with respect to the following examples.

EXAMPLE I

A conventional artificial fingernail is formed by first gluing on a conventional acetate plastic tip approximately 0.01" thick with an adhesive. A mixture of Mona TM Superfine Clear Powder including arcylic ester polymers and benzoyl peroxide is mixed with Mona TM Liquid Acrylic containing ester monomers, dimethyl-p-toluidine and BHT to form a slurry. The slurry is applied rearward of the acetate tip to a thickness slightly greater than the acetate tip and is allowed to harden in situ. Thereafter the surface of the hardened mixture is buffed smooth and flush with the acetate tip and the entire layer over the natural fingernail is polished. The artificial fingernail thus formed stays in place approximately two to three weeks.

EXAMPLE II

In accordance with the invention, a conventional acetate plastic tip approximately 0.04" thick is glued on with Krazy Glue TM on the free end of the natural fingernail. A thin coating of the Krazy Glue TM is applied to the top surface of the natural fingernail rearward of the tip by a wooden stick having a diameter of approximately ¼". Before the thin coating is allowed to dry, a layer of the Mona TM Superfine Clear Powder is applied to the coating to a thickness slightly greater than that of the tip. Upon drying, the top surface thereof is optionally buffed with a fine sandpaper. Thereafter a second thin coating of the Krazy Glue TM is applied to the surface of the polymer layer and allowed to dry. After drying the surface is again buffed until smooth and flush with the surface of the tip. Thereafter nailpolish is applied to the top surface of the entire artificial fingernail. The fingernail remains in place without lifting off for approximately eight weeks.

It is believed that the artificial fingernail according to the present invention has the synergistic quality of hardening when the cyanoacrylate and the acrylic ester polymers mix and at the same time strongly adhering because of the properties of the cyanoacrylate adhesive.

It will be appreciated that the instant specification and claims are set forth by way of illustration and not limitation, and that various modifications and changes may be made without departing from the spirit and scope of the present invention.

What is claimed is:

1. A method of forming an artificial fingernail on a natural fingernail, comprising the steps of:

a. adhering a plastic fingernail tip to the top surface of the free end of a natural fingernail;

b. applying a thin coating of a liquid cyanoacrylate adhesive to the top surface of the natural fingernail rearward of the tip;

c. applying a thin layer of an acrylic ester polymer in powder form on the adhesive coating while still wet;

d. applying a second thin coating of said liquid cyanoacrylate to the surface of the layer after drying; and e. buffing the surface until smooth after the liquid dries.

2. The method according to claim 1, wherein the step of applying the thin layer of polymer comprises applying same with a thickness slightly greater than that of the tip and buffing until the layer and tip are flush.

3. The method according to claim 1 or 2, further comprising applying a coating of fingernail polish to the top surface of the artificial fingernail.

4. The method according to claim 1 or 2, wherein the step of applying the liquid adhesive comprises spreading the adhesive with a wooden stick.

5. The method according to claim 4, wherein the step of buffing comprise applying a fine sandpaper to the exposed surface.

* * * * *

UNITED STATES PATENT AND TRADEMARK OFFICE

CERTIFICATE OF CORRECTION

PATENT NO. : 4,450,848

DATED : May 29, 1984

INVENTOR(S) : Elisa L. Ferrigno

It is certified that error appears in the above-identified patent and that said Letters Patent is hereby corrected as shown below:

| | |
|---|---|
| Under "US. Patent Documents" | 1st line, delete "Jelliner" and substitute --Jellinek-- |
| Col. 1, line 15 | Delete "ernails" and substitute --fingernails-- |
| Col. 2, line 3 | Delete "tip" and substitute --top-- |

Signed and Sealed this

*Twenty-third* Day of *October 1984*

[SEAL]

*Attest:*

GERALD J. MOSSINGHOFF

*Attesting Officer*

*Commissioner of Patents and Trademarks*